US010576312B2

(12) United States Patent
Barbeau et al.

(10) Patent No.: US 10,576,312 B2
(45) Date of Patent: Mar. 3, 2020

(54) FIREFIGHTER PROTECTIVE GARMENT HAVING VARYING COMPOSITE STRUCTURES TO INCREASE DISSIPATION OF METABOLIC HEAT

(71) Applicant: INNOTEX INC., Richmond (CA)

(72) Inventors: Claude Barbeau, St-Bruno (CA); Eric St-Arneault, Sherbrooke (CA)

(73) Assignee: INNOTEX INC. (CA)

( * ) Notice: Subject to any disclaimer, the term of this patent is extended or adjusted under 35 U.S.C. 154(b) by 242 days.

(21) Appl. No.: 15/343,397

(22) Filed: Nov. 4, 2016

(65) Prior Publication Data

US 2017/0120081 A1 May 4, 2017

Related U.S. Application Data

(60) Provisional application No. 62/250,690, filed on Nov. 4, 2015.

(51) Int. Cl.
*A62B 17/00* (2006.01)
*A41D 31/08* (2019.01)

(52) U.S. Cl.
CPC ..... *A62B 17/003* (2013.01); *A41D 31/085* (2019.02); *A62B 17/005* (2013.01)

(58) Field of Classification Search
CPC ..... A41D 31/0022; A41D 31/0027; A62B 17/003; A62B 17/005; A62D 5/00
See application file for complete search history.

(56) References Cited

U.S. PATENT DOCUMENTS

| | | | | |
|---|---|---|---|---|
| 3,710,395 | A | 1/1973 | Spano et al. | |
| 4,922,552 | A * | 5/1990 | Grilliot | A41D 13/0002 2/227 |
| 5,001,781 | A * | 3/1991 | Grilliot | A62B 17/003 2/69 |
| 5,299,602 | A | 4/1994 | Barbeau et al. | |
| 5,323,815 | A | 6/1994 | Barbeau et al. | |
| 5,469,581 | A | 11/1995 | Uthoff | |
| 8,453,270 | B2 | 6/2013 | Blackford | |

* cited by examiner

*Primary Examiner* — Gerard Higgins
(74) *Attorney, Agent, or Firm* — Dilworth IP, LLC

(57) ABSTRACT

A firefighter's protective garment including an outer shell, moisture barrier and thermal barrier in which the composite structure varies according to the sweating cartography of the human body and in so doing enhances the evacuation of metabolic heat.

21 Claims, 2 Drawing Sheets

FIREFIGHTER PROTECTIVE GARMENT HAVING VARYING COMPOSITE STRUCTURES TO INCREASE DISSIPATION OF METABOLIC HEAT

FIELD OF THE INVENTION

The present invention generally relates to the design and construction of a firefighter protective garment. More particularly, the present invention is concerned with using lighter weight and/or thinner materials in those areas of the garment that cover those areas of the human body having the highest propensity for sweating.

BACKGROUND OF THE INVENTION

A firefighter protective garment is usually a coat or a pant consisting of three or more functional layers of fire-resistant materials. The various layers are normally but not limited to the following:

- the outer shell which provides protection against puncture, cuts, abrasion, and heat;
- the moisture barrier—consisting usually of a woven or non-woven substrate to which a fire resistant semi-permeable polymer is coated or laminated—which provides resistance to penetration by liquids and blood-borne pathogens while permitting the transmission of perspiration away from the body of the firefighter.
- the thermal barrier—usually consisting of one or more insulating layers of non-woven fabric quilted or laminated to a woven face cloth—which provides the bulk of the resistance to the transmission of heat from the external environment to the body of the firefighter.

A common configuration and orientation of these layers in a firefighter garment is as follows: The outermost layer is the outer shell fabric. Moving inwards, the next functional layer is the moisture barrier. The last functional layer is the thermal barrier, usually orientated with the thicker and softer insulating layer facing the moisture barrier film and the face cloth towards the body of the firefighter.

The entire outer shell portion of the garment is normally constructed of the same type and weight of fabric throughout the garment, for example, it may be Nomex® IIIA weighing 7.5 ounces per square yard (oz/yd$^2$). Additional layers of the same or different fabrics or materials may be added to various areas of the garment to increase the thermal insulation or abrasion resistance of those areas of the garment.

Similarly, the entire thermal barrier of the garment is normally constructed of the same weight and materials composition irrespective of its location on the garment, for example, a 3.25 oz/yd$^2$ Nomex IIIA woven face cloth fabric quilted to a 4.0 oz/yd$^2$ Nomex®/Kevlar® needle-punch felt. Additional layers of the same or similar thermal barrier material may be added to certain areas of the garment to provide additional thermal protection.

Similarly, the entire moisture barrier of the garment is normally constructed of the same weight and materials composition irrespective of its location on the garment, for example, a 3.3 oz/yd$^2$ 93% Meta-Aramid/5% Para-Aramid/2% Anti-Stat Facecloth Laminated to an ePTFE Film. Additional layers of the same or similar moisture barrier material may be added to certain areas of the garment to provide additional protection.

The firefighter garment, including its outer shell and thermal barrier, must pass the stringent performance requirements of NFPA 1971 if the garment is to be certified compliant with this standard and judged suitable for its intended use. Two critical tests in evaluating the protection and comfort of a firefighter protective garment are the Thermal Protective Performance (TPP) test and the Total Heat Loss (THL) test.

The TPP test assesses the ability of the three component layers of a firefighter garment to retard the transfer of radiant and convective heat from the external environment to body of the firefighter and the NFPA 1971 standard mandates a minimum performance standard of 35 (equal to a heat flux of 2 cal/cm$^2$/sec×a minimum elapsed time of 17.5 seconds until the sensor records the equivalent of a 2nd degree burn).

The Total Heat Loss (THL) test simulates the transfer of metabolic heat through the three component layers of the firefighter garment from the body of the firefighter to his external environment via the mechanisms of conduction and evaporation.

THL performance is, for the most part, inversely proportional to TPP performance and the selection and construction of an outer shell and thermal barrier of a firefighter garment that increases one will usually decrease the other.

A human being involved in the activities of a firefighter generates metabolic heat that must be dissipated if he is to maintain healthy bodily function, and the principal means by which the clothed firefighter body dissipates metabolic heat is by perspiring. In the 1990s, a scientific study (called The Indianapolis Field Study) using human subjects was conducted under the auspices of the International Association of Fire Fighters (IAFF) and demonstrated conclusively and scientifically the physiological impact (ex. on core temperature, heart rate, weight loss, endurance, task performance, etc.) of differing levels of metabolic heat transfer of firefighter garments as measured by the THL test. As a result, the most recent edition of the NFPA 1971 standard mandates a minimum THL performance rating of 205 W/m$^2$.

For a firefighter garment constructed using air-permeable outer shell and thermal barrier materials the THL is inversely proportional to the weight and thickness of those two layers. A firefighter garment with a lighter outer shell or a lighter thermal barrier will therefore have a higher THL than the same layers having a heavier weight.

U.S. Pat. No. 8,453,270B2 discloses a patterned heat management material to be used in garments, sleeping bags, footwear, etc. The object of this invention is to increase the comfort of the user of the object containing the material by retaining and equalizing the distribution metabolic heat through the mechanisms of reflection or conduction. It does not claim to facilitate the evacuation of metabolic heat, nor is it envisaged for use in a firefighter garment.

U.S. Pat. No. 5,469,581A discloses a sports garment for warmth with freedom of movement having thin sections and thick sections where inner arm areas and inner torso areas defined by the area of contact between the arms and torso of the wearer. This invention is designed to retain metabolic heat while aiding mobility. It does not facilitate the dissipation of metabolic heat via the strategic placement of thinner fabric elements.

U.S. Pat. No. 4,922,552 discloses firefighter's garments having maximally insulative, heavier liner materials in areas in which maximum thermal protection is required, such as shoulders, back, thighs, etc. It also has as an object to provide in the same garments lighter, more flexible liner materials 20 (hence, comparatively less thermal insulation) in areas which are flexed and/or which interface with other protective garments. It is not an object of this patent to increase the dissipation of metabolic heat; in fact, the incorporation of heavier liner materials will invariably increase the retention of metabolic heat.

U.S. Pat. Nos. 5,299,602 and 5,323,815A disclose, respectively, textile materials used in the construction of the outer shell and inner lining of a firefighter protective garment, which by being lightweight increase wearer comfort, reduce metabolic energy requirements and decrease metabolic heat build-up. It is an object of these two patents to permit the construction of a firefighter garment that is as light as possible while still respecting the thermal and mechanical performance requirements of NFPA 1971 but they do not have as an object the design or construction of such a protective garment. Furthermore, since there is no claim of using differing weights of the fabrics in different areas of the garment to maximize metabolic heat dissipation and since we know that THL and TPP performance are inversely proportional, a firefighter protective garment made with these materials would theoretically have good THL performance everywhere on the garment, even where it is not needed, and as result, only marginal TPP performance everywhere on the garment, even where higher TPP performance is desirable.

U.S. Pat. No. 3,710,395A discloses an air distribution garment consisting of a layer of an air-permeable, stretchable, compression-resistant, spacer fabric enclosed between layers of stretchable, air-permeable, fabric, having air inlet openings on said garment communicating with manifolds within the garment and through which air is caused to flow over the back and chest portions through the spacer fabric. The object of this invention is to remove excess heat and moisture from the torso to maintain the body in thermal balance. However, the description of the preferred embodiments reveals that the invention is intended to be worn underneath a regular or special-purpose garment and is not intended as a protective garment itself. If it were, the NFPA 1971 performance requirements mandating a level of impermeability to water and to blood-borne pathogens (and as a consequence to air) would render non-compliant with said standard, any firefighter garment incorporating said invention.

However, in light of the aforementioned, there is still a need for a firefighter garment which, by virtue of its design and components, would be able to provide better air circulation between the garment and the wearer thereof.

SUMMARY OF THE INVENTION

The present invention relates to a firefighter garment comprising a plurality of layers forming an outer shell, a moisture barrier and a thermal barrier wherein the weight or unit weight (ex. oz/yd$^2$) of the outer shell and thermal barrier are selectively reduced in pre-determined areas of the garment, in particular those areas of the garment covering parts of the human body with the highest propensity for sweating.

According to the present invention, there is also provided a firefighter garment comprising:

a plurality of layers, each of the layers having at least one of an outer shell property, a moisture barrier property and a thermal barrier property, wherein a weight of at least one of the layers having at least one of the outer shell property or the thermal barrier property is selectively reduced in pre-determined areas of the garment.

Another embodiment of the invention is to use a different moisture barrier in pre-determined areas of the garment, in particular those areas of the garment covering parts of the human body with the highest propensity for sweating.

A third embodiment of this invention is to use composite structure performance as a guideline to use specific composite structures in pre-determined areas of the garment, in particular those areas of the garment covering parts of the human body with the highest propensity for sweating.

It is a further object of the present invention to facilitate evaporative cooling and thereby enhance firefighter comfort.

It is the object of the present invention to improve evaporative cooling and comfort at specific areas inside the garment while maintaining the garment's TPP and THL performance within NFPA 1971 performance requirements.

According to the present invention, there is also provided a firefighter garment comprising:

a plurality of layers, each of the layers having at least one of an outer shell property, a moisture barrier property and a thermal barrier property, wherein at least one of the layers comprises a performance-based composite structure positioned in pre-determined areas of the garment.

The components, advantages and other features of the invention will become more apparent upon reading of the following non-restrictive description of some optional configurations, given for the purpose of exemplification only, with reference to the accompanying figures.

DESCRIPTION OF PREFERRED EMBODIMENTS

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present invention illustrated in other figures can be easily inferred therefrom. The embodiments, geometrical configurations, materials mentioned and/or dimensions shown in the figures are optional, and are given for exemplification purposes only.

Furthermore, although the present invention may be used with various objects, such as firefighter garments, for example, it is understood that it may be used with other types of garments or articles of clothing. For this reason, expressions such as "garments", etc. as used herein should not be taken as to limit the scope of the present invention to these garments in particular. These expressions encompass all other kinds of materials, objects and/or purposes with which the present invention could be used and may be useful, as can be easily understood.

Figure 2:
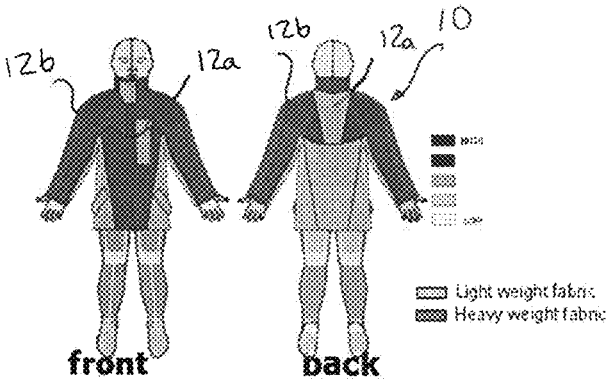
FIG. 2 is a front and back schematic view of a body with a coat garment thereon in accordance with an embodiment of the present invention.
Figure 4:
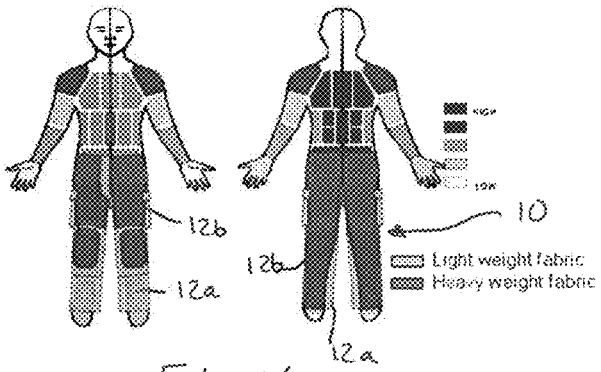
FIG. 4 is a front and back schematic view of a body with a pant garment thereon in accordance with an embodiment of the present invention.
Figure 6:
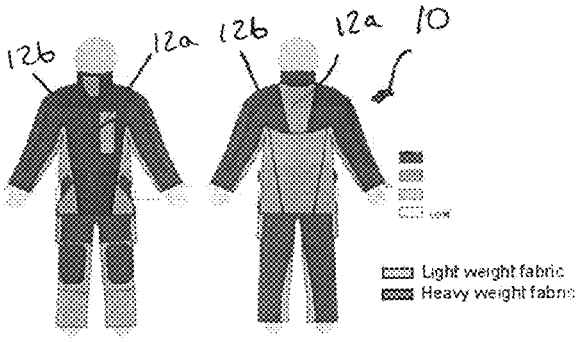
FIG. 6 is a front and back schematic view of a body with a coat and pant garment thereon in accordance with an embodiment of the present invention.

As shown in FIGS. 2, 4 and 6, there is provided a firefighter garment 10 including an outer shell, a moisture barrier, and a thermal barrier. Weight of the outer shell and/or thermal barrier materials are selectively reduced in pre-determined areas of the garment 10. In some implementations, a specific composite of material is used in pre-determined areas of the garment because of its increased THL value.

Figure 1:
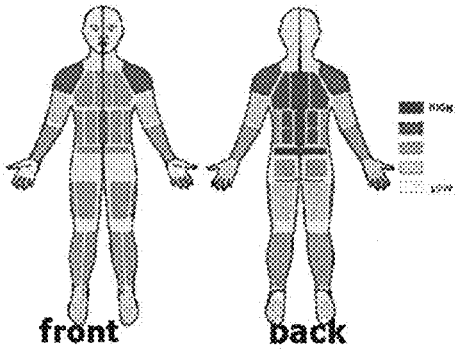
FIG. 1 is a front and back schematic view of a body illustrating body heat zones.
Figure 3:
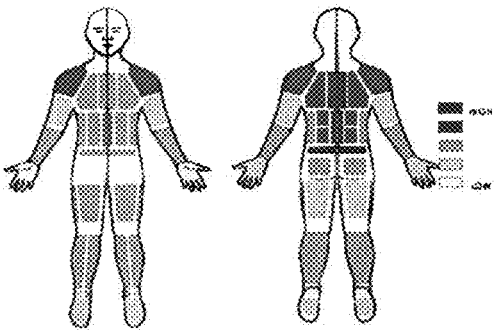
FIG. 3 is a front and back schematic view of a body illustrating body heat zones.
Figure 5:
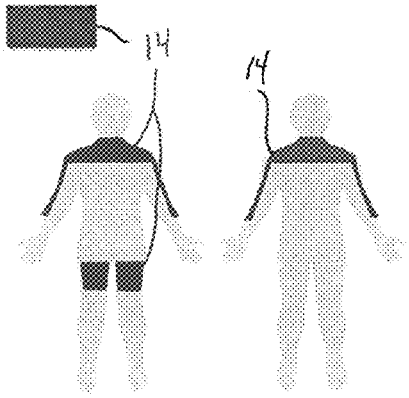
FIG. 5 is a front and back schematic view of a body illustrating body zones subject to high and dangerous heat from exterior sources.

In other implementations, the reduction in weight of pre-determined areas of the outer shell and/or thermal barrier is achieved by assembling the garment 10 with panels 12*a*,12*b* of the outer shell and/or the thermal barrier having differing weights or based on composite structure performance. The multi panel construction allows the garment to be designed with higher protection against high heat in areas 14 (shown in FIG. 5) where it is needed and better breathability for the body when needed in difficult working conditions In some implementations, the panels 12*a*,12*b* of differing weights comprise lighter weight materials, or are based on composite structure performance, and are placed in locations corresponding to bodily areas of high rates of perspiration and metabolic heat transfer that are illustrated in FIGS. 1 and 3. The light weight materials, or composite structures, provide better dispersion of metabolic heat from the body.

In some implementations, the panels 12*a*,12*b* of differing weights of the outer shell and the thermal barrier are made of the same materials as the outer shell and the thermal barrier of a body of the garment, and have a lighter weight, or based on composite structure performance.

In other implementations, the panels 12*a*,12*b* of differing weights of the outer shell and the thermal barrier are made of different materials from the outer shell and the thermal barrier of a body of the garment.

In some implementations, the panels 12*a*,12*b* meet all performance requirements of a NFPA 1971 standard.

In some implementations, the THL value of the composite structure is higher than the THL value for a rest of the garment.

According to the present invention, there is also a provided firefighter garment comprising a plurality of layers, each of the layers having at least one of an outer shell property, a moisture barrier property and a thermal barrier property. At least one of the layers comprises a performance-based composite structure positioned in pre-determined areas of the garment.

In some implementations, the composite structure offers a higher THL value with respect to an adjacent area of the garment and is placed in a location corresponding to a bodily area of high rate of perspiration and metabolic heat transfer.

In some implementations, a layer having a moisture barrier property offers a higher THL value with respect to an adjacent area of the garment and is placed in a location corresponding to a bodily area of high rate of perspiration and metabolic heat transfer.

Of course, numerous modifications could be made to the above-described embodiments without departing from the scope of the invention, as defined in the appended claims.

The invention claimed is:

1. A firefighter protective garment comprising:

a plurality of superimposed layers, the plurality of superimposed layers comprising:

an outer shell defining an outermost layer of the firefighter protective garment, said outer shell comprising:

one or more lightweight outer shell sections aligned with areas of high rates of perspiration and metabolic heat transfer of a firefighter's body when the firefighter protective garment is worn by the firefighter, wherein the areas of high rates of perspiration and metabolic heat transfer comprise at least one of the back of the firefighter, a side torso of the firefighter, or an ankle of the firefighter; and a remainder section of said outer shell, each lightweight outer shell section having a unit weight smaller than a unit weight of the remainder section of said outer shell;

a moisture barrier inwardly affixed to the outer shell; and a thermal barrier inwardly affixed to the moisture barrier, the thermal barrier defining an innermost layer of the plurality of superimposed layers.

2. The firefighter protective garment of claim 1, wherein said one or more lightweight outer shell sections are made from the same material as the remainder section of said outer shell.

3. The firefighter protective garment of claim 1, wherein said one or more lightweight outer shell sections are made from a material different than the remainder section of said outer shell.

4. The firefighter protective garment of claim 1, wherein said one or more lightweight outer shell sections are panels assembled with said remainder section of said outer shell to define the outer shell.

5. The firefighter protective garment of claim 1, wherein said remainder section of said outer shell has a first total heat loss (THL) value and said one or more lightweight outer shell sections have a second THL value, said second THL value being greater than said first THL value.

6. The firefighter protective garment of claim 1, wherein said areas of elevated rates of perspiration and metabolic heat transfer comprise the back of the firefighter.

7. The firefighter protective garment of claim 1, wherein said areas of elevated rates of perspiration and metabolic heat transfer comprise the side torso of the firefighter.

8. The firefighter protective garment of claim 1, wherein said areas of elevated rates of perspiration and metabolic heat transfer comprise the ankle of the firefighter.

9. The firefighter protective garment of claim 1, wherein said outer shell meets all performance requirements of a NFPA 1971 standard.

10. A firefighter protective garment comprising:

a plurality of superimposed layers, the plurality of superimposed layers comprising:

an outer shell defining an outermost layer of the firefighter protective garment, said outer shell comprising:

one or more lightweight outer shell sections aligned with areas of high rates of perspiration and metabolic heat transfer of a firefighter's body when the firefighter protective garment is worn by the firefighter, wherein the areas of high rates of perspiration and metabolic heat transfer comprise at least one of the back of the firefighter, a side torso of the firefighter, or an ankle of the firefighter; and a remainder section of said outer shell, each lightweight outer shell section having a unit weight smaller than a unit weight of a remainder of said outer shell;

a moisture barrier inwardly affixed to the outer shell; and a thermal barrier inwardly affixed to the moisture barrier, said thermal barrier defining an innermost layer of the plurality of superimposed layers, said thermal barrier comprising one or more lightweight thermal barrier sections aligned with said areas of elevated rates of perspiration and metabolic heat transfer of the firefighter's body when the firefighter protective garment is worn by the firefighter and the remainder section of said thermal barrier, each lightweight thermal section having a unit weight smaller than a unit weight of a remainder of said thermal barrier.

11. The firefighter protective garment of claim 10, wherein said one or more lightweight outer shell sections are made from the same material as the remainder section of said outer shell.

12. The firefighter protective garment of claim 10, wherein said one or more lightweight outer shell sections are made from a material different than the remainder section of said outer shell.

13. The firefighter protective garment of claim 10, wherein said one or more lightweight thermal barrier sections are made from the same material as the remainder section of said thermal barrier.

14. The firefighter protective garment of claim 10, said one or more lightweight thermal barrier sections are made from a material different than the section of said thermal barrier.

15. The firefighter protective garment of claim 10, wherein at least one of:

said one or more lightweight outer shell sections are panels assembled with said remainder section of said outer shell to define the outer shell; and said one or more lightweight thermal barrier sections are panels assembled with said remainder section of said thermal barrier to define the thermal barrier.

16. The firefighter protective garment of claim 10, wherein said remainder section of said outer shell has a first total heat loss (THL) value and said one or more lightweight outer shell sections have a second THL value, said second THL value being greater than said first THL value.

17. The firefighter protective garment of claim 10, wherein said remainder section said thermal barrier has a first total heat loss (THL) value and said one or more lightweight thermal barrier sections have a second THL value, said second THL value being greater than said first THL value.

18. The firefighter protective garment of claim 10, wherein said areas of elevated rates of perspiration and metabolic heat transfer comprise the back of the firefighter.

19. The firefighter protective garment of claim 10, wherein said areas of elevated rates of perspiration and metabolic heat transfer comprise the side torso of the firefighter.

20. The firefighter protective garment of claim 10, wherein said areas of elevated rates of perspiration and metabolic heat transfer comprise the ankle of the firefighter.

21. The firefighter protective garment of claim 10, wherein said outer shell and said thermal barrier meet all performance requirements of a NFPA 1971 standard.

* * * * *